US005096139A

United States Patent [19]

Feld et al.

[11] Patent Number: 5,096,139

[45] Date of Patent: Mar. 17, 1992

[54] MISSILE INTERFACE UNIT

[75] Inventors: Charles M. Feld; Darrin C. Griggs, both of Canoga Park; Larry A. Humm, West Hills, all of Calif.

[73] Assignee: Hughes Aircraft Company, Los Angeles, Calif.

[21] Appl. No.: 568,300

[22] Filed: Aug. 16, 1990

[51] Int. Cl.[5] ..... F41G 7/22; F41G 7/34; F42B 15/01

[52] U.S. Cl. ..... 244/3.1; 244/3.15

[58] Field of Search ..... 244/3.1, 3.15

[56] References Cited

U.S. PATENT DOCUMENTS 4,470,562 9/1984 Hall et al. ..... 244/3.2
4,530,476 7/1985 Thurber et al. ..... 244/3.21
4,553,718 11/1985 Pinson ..... 244/3.15
4,705,237 11/1987 Goldfeld et al. ..... 244/3.12
4,899,956 2/1990 King et al. ..... 244/3.21

*Primary Examiner*—John B. Sotomayor
*Attorney, Agent, or Firm*—C. D. Brown; R. M. Heald; W. Denson-Low

[57] ABSTRACT

In a launcher control system (12), a missile interface unit (29) for controlling a ground launched active radar guided missile (GLA) which is modular in construction. The missile interface unit (29) provides target position information and control signals for test and launch of the GLA, and power for activating the GLA, as well as determining the status of the GLA. It employs a plurality of cards (56–70), each card having a specific function and being interconnected by a backplane bus system (55) which also couples the cards (56–70) to other components of the launcher control system (12).

4 Claims, 2 Drawing Sheets

MISSILE INTERFACE UNIT

CROSS REFERENCE TO RELATED APPLICATIONS

This application is related to U.S. Ser. No. 7/447,320 "Launcher Control System" filed Dec. 7, 1989, now issued and its continuation-in-part U.S. Ser. No. 568,298 entitled "Launcher Control System" by Arnold et al, still pending, and U.S. Ser. No. 568,374 entitled "Frequency Synthesizer" by Arnold et al, still pending, filed concurrently with the present application. These documents are hereby incorporated by reference.

BACKGROUND OF THE INVENTION

1. Technical Field

The present invention relates to missile control systems and more specifically to a missile interface unit for a ground launched active radar guided missile (GLA).

2. Discussion

Missile control systems typically employ a missile interface unit capable of relaying guidance information to the missile and monitoring the operation of the missile and its launcher prior to launch. In the documents incorporated by reference, a launcher control system employs an airborne vehicle interface to relay guidance information and control signals to an airborne vehicle and airborne status information back to an operator prior to launch. After launch the airborne vehicle interface controls the transmitter which sends updated guidance information to the airborne vehicle.

A launcher control system must be flexible and efficient to accomplish its mission. While missile interface units are known in the art, prior missile interface units rely on hardware components which are less efficient and limited in the number of tasks they can perform.

SUMMARY OF THE INVENTION

In accordance with the teachings of the present invention a missile interface unit which is part of a launcher control system for controlling the launch and flight of a missile is provided. In the preferred embodiment, the missile interface unit is used to control a ground launched active radar guided missile (GLA), such as the Advanced Medium Range Air-to-Air Missile (AMRAAM) although the present invention is suitable for controlling other airborne vehicles. The missile interface unit provides target position information and control signals for test and launch of the GLA, and power for activating the GLA. It employs a plurality of cards interconnected by a backplane bus system, which also serves to couple the cards to other components of the launcher control system. Each card has a specific function and is easily removable and replaceable.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
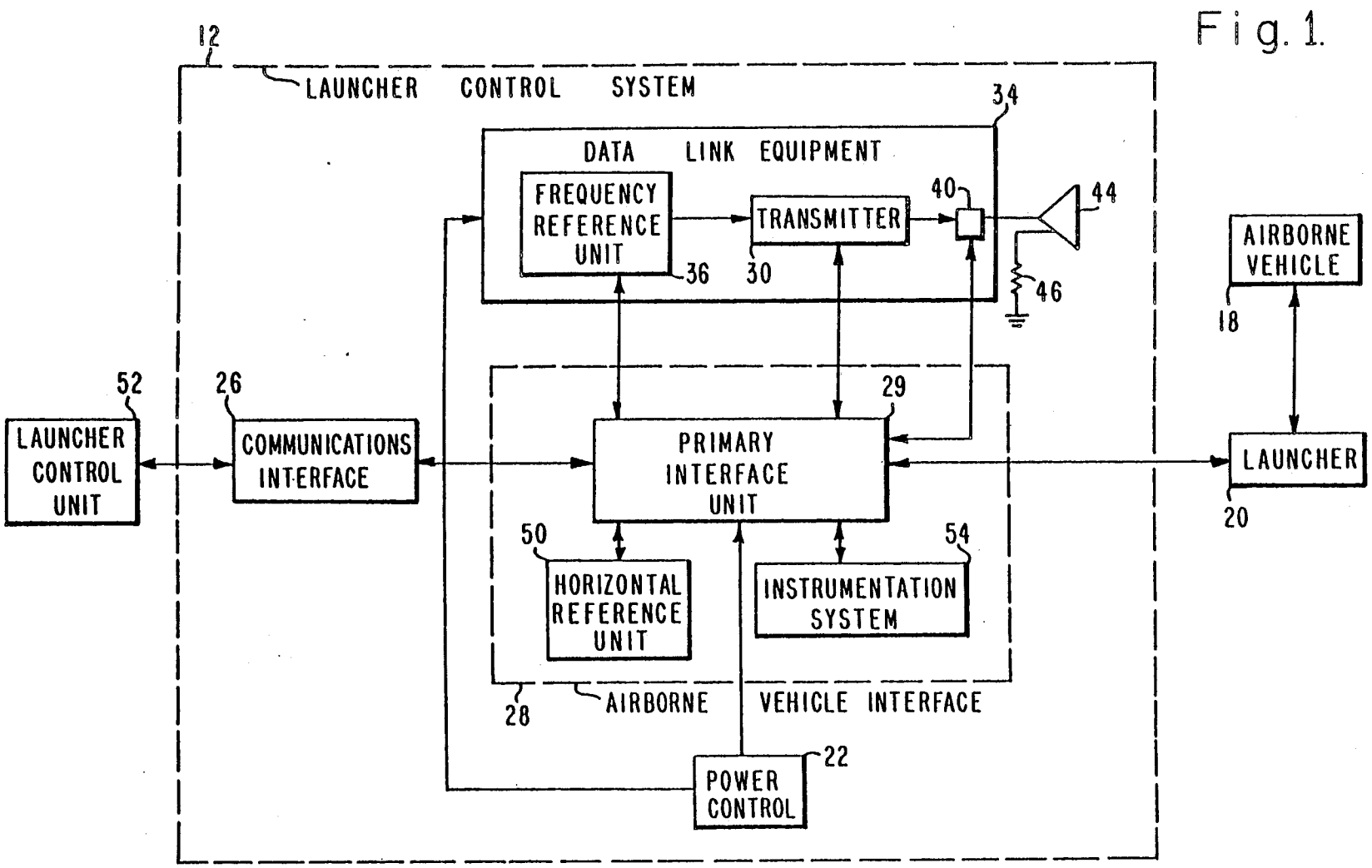
FIG. 1 is a schematic diagram of the launcher control system.

There is shown in FIG. 1 a launcher control system 12 in which the present invention finds particular utility. Data link equipment 34 contains a frequency reference unit 36, a transmitter 30, and a load control switch 40. The frequency reference unit 36 produces a band of frequencies within the X-band of the electromagnetic spectrum.

Transmitter 30 transmits the output signal from the frequency reference unit 36. It contains a travelling wave tube amplifier for amplifying the X-band electromagnetic signal.

The load control switch 40 directs the output of the transmitter 30 to the antenna 44 or a dummy load 46. The dummy load 46 is provided to allow for field tests of the data link equipment 34 without danger of spurious microwave radiation. The antenna 44 employs four antenna subsystems each covering a 90 degree swath about the center of the antenna 44.

The airborne vehicle interface 28 provides a variety of control functions throughout the launcher control system 12. The primary interface unit 29 within the housing 24 corresponds to the missile interface unit of the present invention. Briefly, it implements frequency change orders to the frequency reference unit 36, monitors the frequency reference unit 36 for frequency drift, and performs a built-in test of frequency reference unit functions. It signals the transmitter 30 to transmit a pulse code to the airborne vehicle 18, monitors the output power of the transmitted pulse waveform, monitors the transmitter 30 for failure, and performs a built-in test function. It selects the antenna subsystem to be illuminated by the data link equipment 34. Finally, it implements a built-in test function for horizontal reference unit 50.

Horizontal reference unit 50 is a subsystem of the airborne vehicle interface 28 located outside the housing 24 which measures the inclination of the launcher rotating platform. It sends digitized roll and pitch information to the primary interface unit 29. The use of a horizontal reference unit allows accurate determination of elevation plane not only during initial setup but between launches to account for platform movement.

The launcher control unit 52 implements the firing orders of the operator and implements self-test functions for the airborne vehicle interface 28. It also relays targeting information to the airborne vehicle interface 28.

Instrumentation system 54 is a subsystem of the airborne vehicle interface 28. It too is located outside the housing 24. It is a data collection system used to monitor operation of the airborne vehicle interface 28. This capability is particularly valuable for system integration and for performance evaluation.

The airborne vehicle interface 28 is coupled to the launcher control unit 52 through the communications interface 26, which employs one or more standard serial communications interface units and one or more discrete serial communications interface units.

The airborne vehicle interface 28 communicates with the launcher 20 through a series of interfaces. A standard differential serial interface 1533 is used as well as several discrete interfaces.

The power distribution unit 32 provides 28 volt DC power to the data link equipment 34 and the airborne vehicle interface 28. It receives three-phase 400 Hertz power from power source 22. Three-phase 400 Hertz power is also sent to the airborne vehicle interface 28. Three-phase power and 28 volt DC power are sent to the launcher 20 via the airborne vehicle interface 28.

Figure 2:
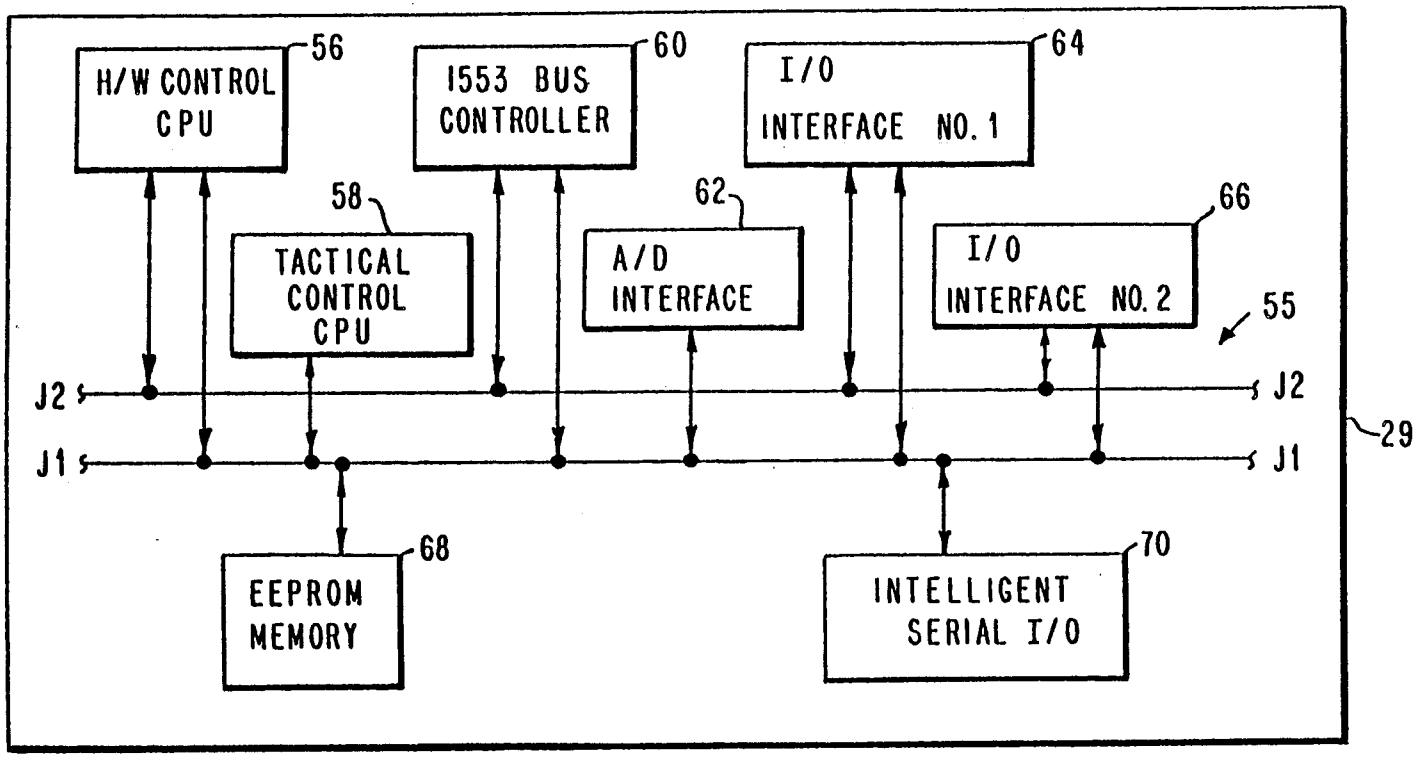
FIG. 2 is a schematic diagram of the missile interface unit.

FIG. 2 illustrates the basic components of the missile interface unit 29 of the present invention. In the preferred embodiment, it consists of a plurality of cards 56–70 or subsystems each having a specific function, which are interconnected through a standard Versa Module Europa (VME) bus 55 manufactured by Motorola. The VME bus 55 is a backplane system consisting of buses J1 and J2. Advantageously, the VME bus 55 enhances mission flexibility by permitting cards to be added or subtracted as required by a particular airborne vehicle 18 or mission. In the preferred embodiment, eight cards are used to control a ground launched active radar guided missile (GLA), namely, the Advanced Medium Range Air-to-Air Missile (AMRAAM).

The tactical control central processing unit (CPU) 58 runs the tactical software and is the main missile interface unit controller. In the preferred embodiment, the DMV 152 card manufactured by DY-4 Systems is employed. The DMV 152 card is a sophisticated CPU which allows the missile interface unit 29 to be intelligent and flexible. It performs three major functions: initialization, message processing, and missile launch regulation and track file management. The initialization function controls the launch sequence, transmits a prelaunch message to prepare the missile for launch and establishes the mode of the missile. The missile has two modes, the first being tracking with the help of targeting information from the missile interface unit 29, and the second being tracking by relying on its own actively generated target information. The initialization function also recognizes the type of targeting sensor being used and establishes operation as a test or actual launch.

The message processing function of the tactical control CPU 58 is a two-way translation function. The tactical control CPU 58 converts target parameters into signals the missile can understand and converts missile parameters into signals the launcher control unit 52 can understand. When the missile is airborne, it prepares targeting parameters for transmission via the data link equipment 34.

In managing missile launch regulation and track file management, the tactical control CPU 58 ensures that no more than six missiles are in the air at any one time. The tactical control CPU 58 regulates message traffic and sequences transmission of the data link equipment 34 so that message traffic to each of the missiles is transmitted when the missiles are looking for the message traffic. Track file management includes managing tracking information from the targeting sensor so that each missile receives the correct targeting information.

The hardware (H/W) control CPU 56 functions as an interface between the tactical software in the tactical control CPU 58 and the data link equipment 34 providing all necessary synchronization and timing. By using a CPU to control data link timing, this system is far more flexible than one using dedicated hardware to perform this task. This flexibility allows for a variable number of missiles and different message formats. It provides a protocol for message traffic and formats the message traffic for transmission. The hardware control CPU 56 also has a built-in test function which checks each subsystem of the missile interface unit 29 when power is applied. In the preferred embodiment, the DMV 152 card manufactured by DY-4 Systems is used.

The analog-to-digital (A/D) interface 62 is used to convert analog signals to digital format for input to the tactical control CPU 58 and the hardware control CPU 56. Specifically, the analog signals include output signals from the transmitter 30. Transmitter power and other power forms within the launcher control system are also digitized. By digitizing transmitter power and power supply voltages, the self test capabilities of the system are greatly increased. Finally, the A/D interface 12 is capable of converting analog signals from an optional range finder into digital format. In the preferred embodiment, the DMV 666 card manufactured by DY-4 Systems is used.

The memory card 68 contains an electronic erasable programmable read-only-memory (EEPROM) and a static random access memory (SRAM) for use by the tactical control CPU 58 and the hardware control CPU 58. When power is applied to the missile interface unit 29, stored executable code from the EEPROM is loaded into SRAM. Temporary hold executable code for the tactical control CPU 58 and hardware control CPU 56 is also transferred to SRAM for speed. In the preferred embodiment, the DMV 536 card manufactured by DY-4 Systems is used. The memory card 68 is capable of expansion to a size many times the current system memory requirements. This allows for great system flexibility and room for expanded functionality.

The 1553 bus controller 60 off-loads much routine work from the tactical control CPU 58. It translates the tactical software missile communication from the tactical control CPU 58 into the correct protocol and format for transmission to any missile using this standard protocol along the 1553 serial bus, which is a link for transferring umbilical messages to the missile via the launcher 20. The 1553 bus controller 60 also signals each missile to perform its own built-in test function. Status information is relayed back to the missile interface unit 28 from the launcher 20 along the 1553 serial bus. In the preferred embodiment, the PMV MBI card manufactured by Radstone is used.

In the preferred embodiment, the intelligent serial input/output interface 70 and the input/output interface units 64 and 66 perform the functions of the communications interface 26. The intelligent serial input/output interface 70 has a large interface memory and four channels for serial communication which allow the tactical control CPU 58 to communicate with the launcher control unit 52 with a minimum of overhead. Each of the four channels employs a standard RS422 communications interface. Serial communication from the launcher control unit 52 to the missile interface unit 29 includes tracking information to be used by the missile. Information from the missile interface unit 29 to the launcher control unit 52 consists of built-in test information from the various launcher control system components. In the preferred embodiment, the PMV 68-MPCC-1 card manufactured by Radstone is used.

Input/output interface units 64 and 66 are specifically tailored to control a variety of functions. The interfaces to which these cards connect are very specific; it is most efficient to lump all of the custom functions into one part of the system. This allows the missile interface unit 29 to be tailored to other missile control systems by the simple replacement of these cards. They handle serial communication between the missile interface unit 29 and the data link equipment 34 by programming serial communication into a special communications format. They control the antenna 44 and its quadrant switching.

They control removal of the tops from the missile canisters and they generate 28 volt signals to be transmitted to the launcher 20 over a discrete interface. Due to space constraints on each card, two cards are used.

Although the invention has been described with particular reference to certain preferred embodiments thereof, variations and modifications can be effected within the spirit and scope of the following claims.

What is claimed is:

1. A launcher control system, for controlling at least one airborne vehicle, comprising a) primary interface means for providing target position information and control signals for test and launch of said airborne vehicle, and b) means for supplying power for activating said airborne vehicle as well as determining the status of said airborne vehicle; said primary interface means including a plurality of cards, each card for performing a specific function, and bus means for interconnecting said cards and for coupling said cards to other components of the launcher control system, said plurality of cards comprising:

a tactical control card for initializing the airborne vehicle for launch, for translating target and guidance information for transmission to the airborne vehicle after launch, for sequencing message traffic after launch, and for managing target information;

a hardware control card for testing and monitoring operation of said plurality of cards, a horizontal reference unit, and an instrumentation system, and for sequencing and formatting message traffic;

an analog-to-digital card for converting analog signals to digital signals for input to said tactical control card and hardware control card;

a memory card for storing executable code for said tactical control card and hardware control card;

a launcher bus controller card for translating tactical messages into a proper protocol and format for transferring the messages to the airborne vehicle through the launcher, and for receiving status information from the airborne vehicle;

an input/output card for managing communication between a launcher control unit and said primary interface means, said communication including status information from the launcher control system and guidance information to said airborne vehicle; and an input/output interface card for managing communication between the primary interface means and a transmitter, for controlling an antenna coupled to the transmitter and for providing power to said launcher.

2. The launcher control system as recited in claim 1 used to control a plurality of airborne vehicles.

3. The launcher control system of claim 2 wherein said airborne vehicles are each a ground launched active radar guided missile.

4. The launcher control system as recited in claim 1 wherein each card of said plurality of cards is easily removable from the launcher control system and easily replaceable.

* * * * *